US012104471B2

(12) United States Patent
Lee et al.

(10) Patent No.: US 12,104,471 B2
(45) Date of Patent: Oct. 1, 2024

(54) MULTI-PLUNGER LIFT CONTROL DEVICE

(71) Applicant: NAONWORKS Co., Ltd., Seoul (KR)

(72) Inventors: June Kyoung Lee, Seoul (KR); Seong Woo Lee, Seoul (KR); Jae Yoon Shim, Seoul (KR); Ji Su Oh, Paju-si (KR)

(73) Assignee: NAONWORKS Co., Ltd., Seoul (KR)

( * ) Notice: Subject to any disclaimer, the term of this patent is extended or adjusted under 35 U.S.C. 154(b) by 51 days.

(21) Appl. No.: 17/840,759

(22) Filed: Jun. 15, 2022

(65) Prior Publication Data

US 2023/0383628 A1 Nov. 30, 2023

(30) Foreign Application Priority Data

May 27, 2022 (KR) ..... 10-2022-0065623

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... F04B 47/12; E21B 43/121; E21B 43/13
See application file for complete search history.

(56) References Cited

U.S. PATENT DOCUMENTS 8,863,837 B2 10/2014 Bender et al. ..... 166/250.15
11,319,785 B1 * 5/2022 Green ..... E21B 43/122

* cited by examiner

*Primary Examiner* — Kristyn A Hall
(74) *Attorney, Agent, or Firm* — Stein IP, LLC

(57) ABSTRACT

The present disclosure relates to a multi-plunger lift control device for increasing device durability and production efficiency by synchronizing and controlling operating states of a plurality of plunger lifts sharing some production lines. The multi-plunger lift control device according to the present disclosure includes a plunger lift synchronization setting unit configured to set an operation priority of the plurality of plunger lifts so that production stages of the plurality of plunger lifts do not collide, a stage monitoring unit for each plunger lift configured to monitor current production stages of the plurality of plunger lifts, and a plunger lift logic control unit configured to synchronize and control production operations of the plurality of plunger lifts based on the operation priority set by the plunger lift synchronization setting unit and stage monitoring information received from the stage monitoring unit for each plunger lift. The multi-plunger lift control device according to the present disclosure can increase device durability and production efficiency by synchronizing and controlling operating states of the plurality of plunger lifts in an environment that shares a production line for transporting oil and/or gas produced in a plurality of oil and/or gas wells, in which the plurality of plunger lifts are installed, to a remote storage.

7 Claims, 5 Drawing Sheets

PRIOR ART

PRIOR ART

MULTI-PLUNGER LIFT CONTROL DEVICE

CROSS-REFERENCE TO RELATED APPLICATIONS

This application claims the benefit of Korea Patent Application No. 10-2022-0065623 filed on May 27, 2022, which is incorporated herein by reference for all purposes as if fully set forth herein.

TECHNICAL FIELD

The present disclosure relates to a multi-plunger lift control device. More specifically, the present disclosure relates to a multi-plunger lift control device for increasing device durability and production efficiency by synchronizing and controlling operating states of a plurality of plunger lifts sharing a production line.

BACKGROUND

A plunger lift is a kind of artificial lift method for producing an oil and/or a gas from an oil and/or gas well.

A production method using the plunger lift is described as follows.

FIG. 1 illustrates an exemplary configuration of a plunger lift according to a related art. FIG. 2 illustrates a plunger lift control method according to a related art.

Referring to FIGS. 1 and 2, a plunger lift method is a method of producing an oil and/or a gas by drilling from an oil and/or gas well to a reservoir where the oil and/or gas is buried and stored and then installing tubing or casing in a drilled space. Further, the plunger lift method is a method of producing the oil and/or gas by periodically extracting foreign substances such as oil, groundwater, and mud, which are loaded inside the tubing or the casing over time and hinder the production, to the ground using a plunger.

Oil, gas, etc. pulled up from the underground are transported through a production line connected to a storage tank and are stored in the storage tank.

Such a plunger lift operates in a cycle of a drop stage of closing a production valve installed on the production line and dropping the plunger to the bottom of the reservoir by gravity, a shut-in stage of waiting until a pressure inside the reservoir and the tubing increases as needed for production, a lifting stage of raising the plunger by a pressure difference between the tubing and the production line by opening the production valve and waiting until the plunger reaches the ground, and an afterflow stage of transferring oil, water, mud, etc. in the tubing to the storage tank on the ground.

When a multi-plunger lift well is constructed by drilling several tubings in a single wellpad, each control device controlling the plunger lifts performs an independent production cycle regardless of operating states of other control devices, or performs a production cycle while waiting until it receives a valve open control instruction from a central control device connected to multiple plunger lift controllers when sharing a single production line.

As described above, in a production environment in which the multi-plunger lift well is constructed by drilling the several tubings in the single wellpad, and two or more plunger lifts share the production line for transporting oil, gas, etc., drawn from the reservoir to the storage tank, when the two or more plunger lifts open the production valve at the same time to start production, there is a problem that a pressure is concentrated on the production line by each plunger lift and thus a pressure of the production line may rapidly increases, or oil and/or gas produced in one oil well may flow back into the production line of another oil well due to the pressure difference in the tubing of each plunger lift.

PRIOR ART DOCUMENT

Patent Document (Patent Document 1) U.S. Pat. No. 8,863,837 B2 (titled "PLUNGER LIFT CONTROL SYSTEM ARRANGEMENT" registered on Oct. 21, 2014)

SUMMARY

A technical object of the present disclosure is to provide a multi-plunger lift control device capable of increasing device durability and production efficiency by synchronizing and controlling operating states of a plurality of plunger lifts in an environment that shares a production line for transporting an oil and/or a gas produced in a plurality of oil and/or gas wells, in which the plurality of plunger lifts are installed, to a remote storage.

Another technical object of the present disclosure is to provide a multi-plunger lift control device capable of preventing an abnormal pressure increase in a production line shared by a plurality of plunger lifts and preventing a backflow from the shared production line to an individual oil and/or gas well by synchronizing and controlling operating states of the plurality of plunger lifts.

In order to achieve the above-described and other objects, in one aspect of the present disclosure, there is provided a multi-plunger lift control device increasing device durability and production efficiency by synchronizing and controlling operating states of a plurality of plunger lifts sharing some production lines, the multi-plunger lift control device comprising a plunger lift synchronization setting unit configured to set an operation priority of the plurality of plunger lifts so that production stages of the plurality of plunger lifts do not collide, a stage monitoring unit for each plunger lift configured to monitor current production stages of the plurality of plunger lifts, and a plunger lift logic control unit configured to synchronize and control production operations of the plurality of plunger lifts based on the operation priority set by the plunger lift synchronization setting unit and stage monitoring information received from the stage monitoring unit for each plunger lift.

The production stage comprises a drop stage of dropping a plunger to a bottom of a reservoir, in which an oil and/or a gas is stored, through a tubing, a shut-in stage of waiting until an internal pressure of the tubing reaches a set producible pressure, a lifting stage of lifting the plunger to a ground using an internal pressure difference between the tubing and a production line by opening a production valve installed on a production line on the ground connecting the tubing and an external storage, and an afterflow stage of discharging foreign substances in the tubing. The plunger lift logic control unit synchronizes and controls the production operations of the plurality of plunger lifts so that two or more plunger lifts of the plurality of plunger lifts do not perform the lifting stage and the afterflow stage at the same time.

The plunger lift logic control unit synchronizes and controls the production operations of the plurality of plunger lifts to prevent an excessive pressure increase of a shared production line shared by the plurality of plunger lifts and to prevent a backflow due to a pressure difference between the shared production line and a non-shared production line that is not shared by the plurality of plunger lifts.

The plunger lift logic control unit generates a control logic for each of the plurality of plunger lifts based on the operation priority set by the plunger lift synchronization setting unit, and at least a priority of the lifting stage and the afterflow stage among the production stage of each of the plurality of plunger lifts is included in the control logic for each of the plurality of plunger lifts.

The plunger lift logic control unit performs the control logic for each of the plurality of plunger lifts. A control logic of a specific plunger lift included in the plunger lift logic control unit synchronizes and controls the production operations of the plurality of plunger lifts with reference to a control logic of other plunger lift before opening a specific production valve controlled by the specific plunger lift so as to perform the lifting stage and the afterflow stage, to thereby prevent a collision between the production stages of the plurality of plunger lifts.

The multi-plunger lift control device further comprises a plunger lift statistical information generation unit configured to compare and analyze control operation environment data and production data of the plurality of plunger lifts that change over time, and generate statistical information that supports a user to set the operation priority of the plurality of plunger lifts through the plunger lift synchronization setting unit.

The statistical information includes production quantity information per production cycle of the plurality of plunger lifts and daily production quantity information of the plurality of plunger lifts.

The statistical information further includes information on production cycle during a unit period of the plurality of plunger lifts, and information on occupation time for each production stage, current production stage progress time, and progress.

The statistical information is provided on one screen for mutual comparison for each of the plurality of plunger lifts and supports the user to set the operation priority of the plurality of plunger lifts through the plunger lift synchronization setting unit.

The statistical information further includes information on a plunger lifting speed per production cycle of the plurality of plunger lifts.

The present disclosure can increase device durability and production efficiency by synchronizing and controlling operating states of a plurality of plunger lifts in an environment that shares a production line for transporting an oil and/or a gas produced in a plurality of oil and/or gas wells, in which the plurality of plunger lifts are installed, to a remote storage.

The present disclosure can also prevent an abnormal pressure increase in a production line shared by a plurality of plunger lifts and prevent a backflow from the shared production line to an individual oil and/or gas well by synchronizing and controlling operating states of the plurality of plunger lifts.

The present disclosure can also perform a continuous oil and/or gas production process even in a minimal production facility environment by configuring efficient control logic synchronization for a plurality of plunger lifts in an oil and/or gas well production control environment of the plurality of plunger lifts sharing a production line, and can support to perform optimal production control by comparing and providing various operating states and production data statistical information for optimal operation of the oil and/or gas well.

BRIEF DESCRIPTION OF THE DRAWINGS

The accompanying drawings, which are included to provide a further understanding of the disclosure and are incorporated in and constitute a part of the disclosure, illustrate embodiments of the disclosure and together with the description serve to explain the principle of the disclosure.

DETAILED DESCRIPTION

A specific structural or functional description in embodiments according to concept of the present disclosure disclosed in this specification is merely given for the purpose of explaining embodiments according to the concept of the present disclosure. Embodiments according to the concept of the present disclosure can be implemented in various forms and are limited to the embodiments described in the present disclosure.

Since embodiments according to concept of the present disclosure can apply variations and modifications and can have various forms, the embodiments are illustrated in the accompanying drawings and are described in detail in this specification. However, this is not intended to limit embodiments according to the concept of the present disclosure to specific disclosed forms, and includes all of alterations, equivalents, or substitutes included in the spirit and the technical scope of the present disclosure.

Unless otherwise defined, all the terms used herein including technical or scientific terms indicate the same meaning as terms that are generally understood by a person having ordinary skill in the art to which the present disclosure pertains. Terms defined in the dictionary generally used should be interpreted as having a meaning consistent with the meaning in the context of the related art, and are not interpreted as an idealistic or overly formal meaning unless explicitly defined in this specification.

Reference will now be made in detail to embodiments of the disclosure, examples of which are illustrated in the accompanying drawings.

Figure 1:
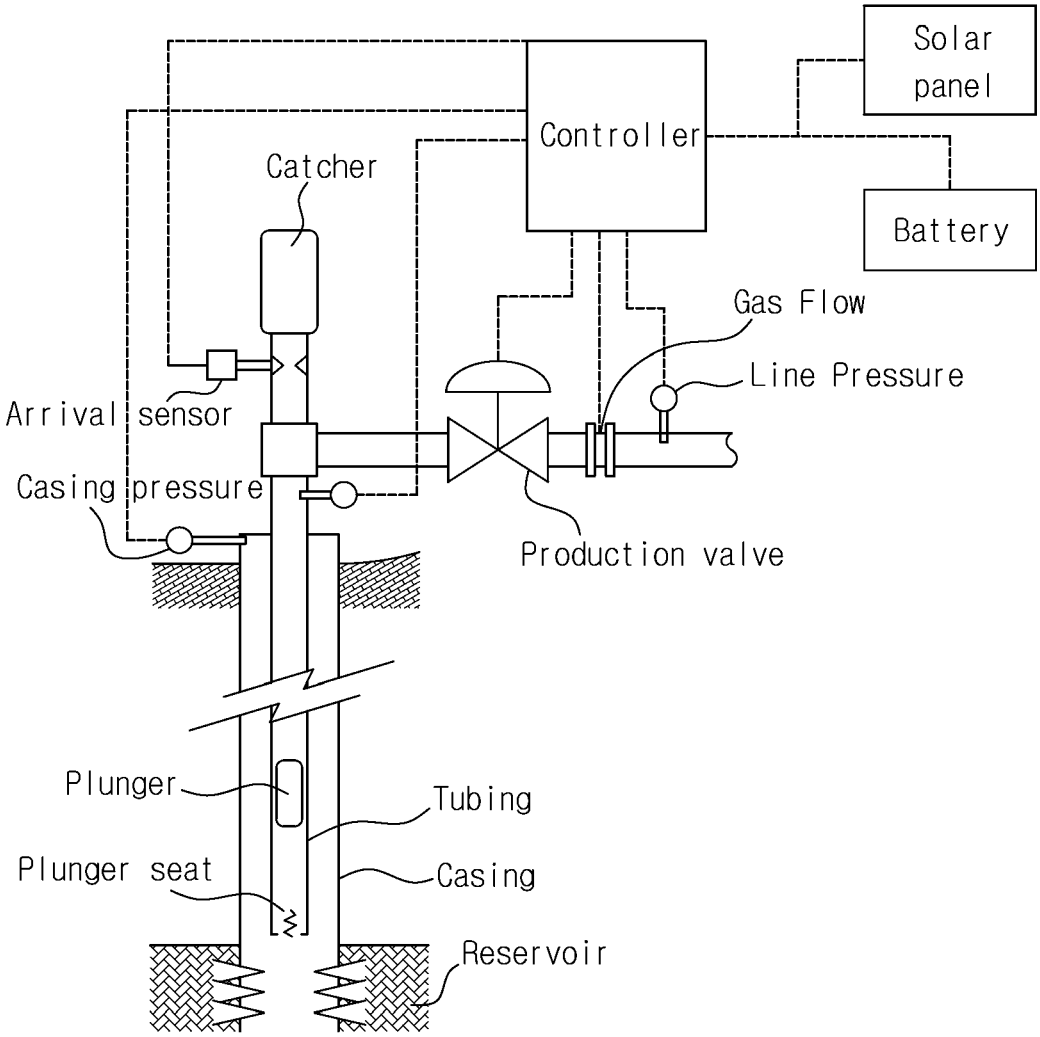
FIG. 1 illustrates an exemplary configuration of a plunger lift according to a related art.
Figure 2:
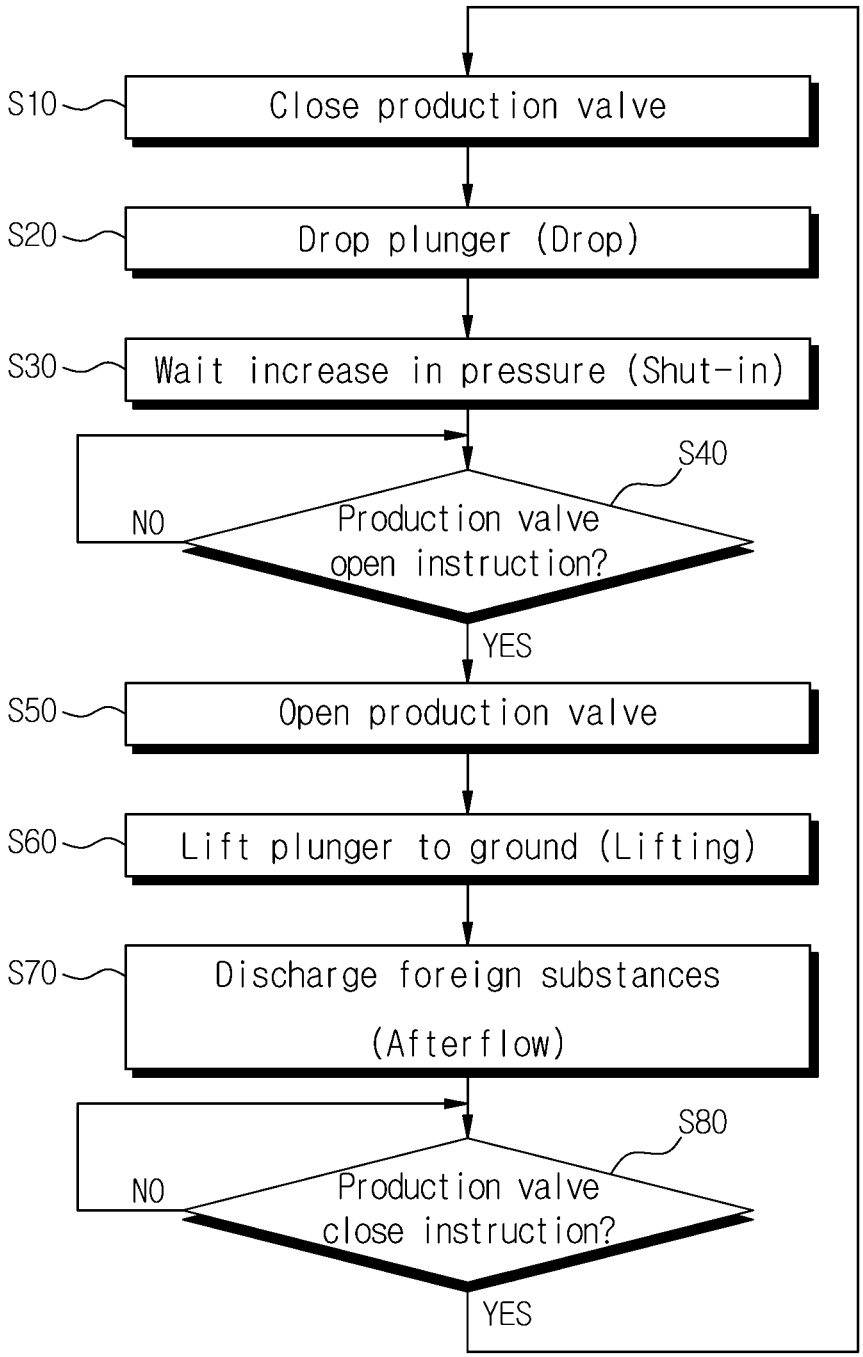
FIG. 2 illustrates a plunger lift control method according to a related art.
Figure 3:
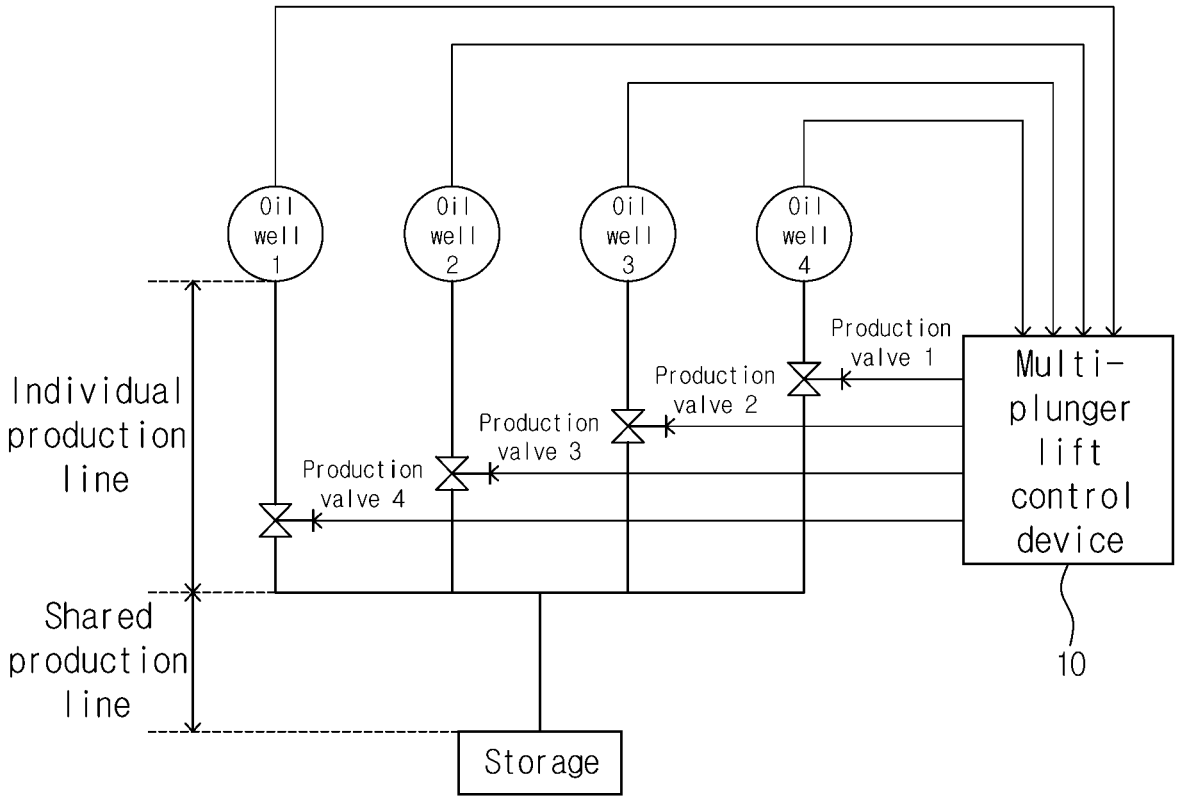
FIG. 3 illustrates an example of a system environment in which a multi-plunger lift control device according to an embodiment of the present disclosure is installed.

FIG. 3 illustrates an example of a system environment in which a multi-plunger lift control device 10 according to an embodiment of the present disclosure is installed.

Referring to FIG. 3, in a production environment in which a multi-plunger lift well is constructed by drilling several tubings in a single wellpad, and two or more plunger lifts share some of production lines, i.e., a shared production line for transporting oil, gas, etc., drawn from a reservoir to a storage tank, when the two or more plunger lifts open a production valve at the same time to start production, there is a problem that a pressure is concentrated on the shared production line by each plunger lift and thus a pressure of the shared production line may rapidly increase, or the oil and/or gas produced in one oil well may flow back into an individual production line of another oil well due to a pressure difference in the tubing of each plunger lift.

The present disclosure is to solve the above-described problem, and detailed configuration is described as follows.

Figure 4:
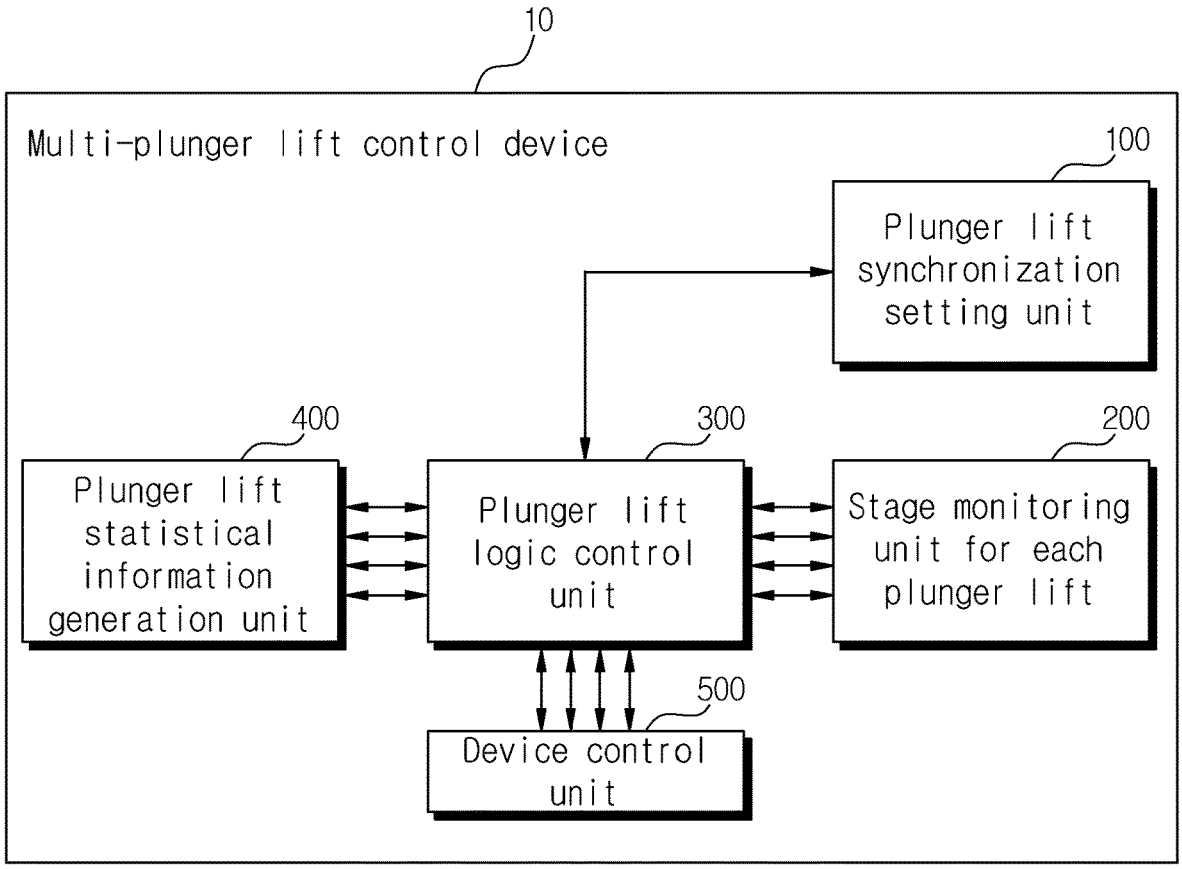
FIG. 4 illustrates a multi-plunger lift control device according to an embodiment of the present disclosure.

FIG. 4 illustrates a multi-plunger lift control device 10 according to an embodiment of the present disclosure.

Referring to FIG. 4, an embodiment of the present disclosure describes a multi-plunger lift control device 10 for increasing device durability and production efficiency by synchronizing and controlling operating states of a plurality of plunger lifts sharing some of production lines. The multi-plunger lift control device 10 includes a plunger lift synchronization setting unit 100, a stage monitoring unit 200 for each plunger lift, a plunger lift logic control unit 300, a plunger lift statistical information generation unit 400, and a device control unit 500.

The plunger lift synchronization setting unit 100 is a component that sets an operation priority of the plurality of plunger lifts so that production stages of the plurality of plunger lifts do not collide.

As a detailed example, the plunger lift synchronization setting unit 100 determines the priority of the plunger lift through a statistical information analysis and an operating experience of a user, and sets a plunger lift production stage adjustment. That is, the user may set the plurality of plunger lifts through the plunger lift synchronization setting unit 100 so that a production stage of a control logic of each plunger lift can be proceeded harmoniously without collision.

For example, the production stages of the plurality of plunger lifts may be configured to include a drop stage of dropping a plunger to a bottom of a reservoir, in which an oil and/or a gas is stored, through a tubing, a shut-in stage of waiting until an internal pressure of the tubing reaches a set producible pressure, a lifting stage of lifting the plunger to the ground using an internal pressure difference between the tubing and a production line by opening a production valve installed on a production line on the ground connecting the tubing and an external storage, and an afterflow stage of discharging foreign substances in the tubing.

The stage monitoring unit 200 for each plunger lift is a component that monitors current production stages of the plurality of plunger lifts and stores a result of monitoring.

As a detailed example, the stage monitoring unit 200 for each plunger lift monitors a production control logic state of the plurality of plunger lifts and provides information on a production stage of another plunger lift that is considered when determining whether to open and close the production valve and whether to proceed to a next production stage in each plunger lift control logic.

The plunger lift logic control unit 300 is a component that synchronizes and controls production operations of the plurality of plunger lifts based on the operation priority set by the plunger lift synchronization setting unit 100 and stage monitoring information received from the stage monitoring unit 200 for each plunger lift.

For example, the plunger lift logic control unit 300 may be configured to synchronize and control production operations of the plurality of plunger lifts so that two or more plunger lifts of the plurality of plunger lifts do not perform the lifting stage and the afterflow stage at the same time.

For example, the plunger lift logic control unit 300 may be configured to synchronize and control the production operations of the plurality of plunger lifts to thereby prevent an excessive pressure increase of a shared production line shared by the plurality of plunger lifts and prevent a backflow due to a pressure difference between the shared production line and a non-shared production line, i.e., an individual production line that is not shared by the plurality of plunger lifts.

For example, the plunger lift logic control unit 300 may be configured to generate a control logic for each of the plurality of plunger lifts based on the operation priority set by the plunger lift synchronization setting unit 100. At least a priority of the lifting stage and the afterflow stage among the production stage of each of the plurality of plunger lifts is included in a control logic for each of the plurality of plunger lifts.

For example, the plunger lift logic control unit 300 may be configured to perform a control logic for each of the plurality of plunger lifts, and a control logic of a specific plunger lift included in the plunger lift logic control unit 300 may be configured to synchronize and control the production operations of the plurality of plunger lifts with reference to a control logic of other plunger lift before opening a specific production valve controlled by the specific plunger lift so as to perform the lifting stage and the afterflow stage. Hence, the plunger lift logic control unit 300 can prevent a collision between the production stages of the plurality of plunger lifts.

As a more detailed example, the plunger lift logic control unit 300 checks a production stage of a plunger lift control logic with a high priority managed by the stage monitoring unit 200 for each plunger lift when opening the production valve in a plunger lift control logic of opening and closing a conventional basic production valve, and proceeds to a next stage.

Even in the lifting stage and the afterflow stage that are the production stage of opening the production valve, the plunger lift logic control unit 300 checks a production stage of other plunger lift control logic and determines whether to continue to produce through continuous opening of the production valve or whether to hand over production line usage rights in other plunger lift control logic with a high priority.

When the production valve needs to be closed in the middle due to occupation of the production line by opening the production valve of the plunger lift with the high priority, the plunger lift logic control unit 300 immediately closes the production valve even if a closing condition of the production valve is not satisfied, and proceeds to the drop stage and proceeds to a next production cycle.

In order to monitor and manage stages of a plurality of plunger lift controllers in a single controller, a control logic and a production stage progress state of each plunger lift are transmitted through an internal communication (IPC), or a shared memory or an internal database may be used if the same system memory area is used.

The plunger lift statistical information generation unit 400 is a component that compares and analyzes control operation environment data and production data of the plurality of plunger lifts that change over time, generates statistical information that supports the user to set the operation priority of the plurality of plunger lifts through the plunger lift synchronization setting unit 100, and provides the generated statistical information to the user.

For example, the statistical information may include production quantity information per production cycle of the plurality of plunger lifts and daily production quantity information of the plurality of plunger lifts, information on production cycle during a unit period of the plurality of plunger lifts, and information on occupation time for each production stage, current production stage progress time, and progress.

For example, the statistical information may be provided on one screen for mutual comparison for each of the plurality of plunger lifts, and may support the user to set the operation priority of the plurality of plunger lifts through the plunger lift synchronization setting unit 100.

For example, in order to determine a priority of each plunger lift and for facility safety and efficient operation, the statistical information may include information on a plunger lifting speed per production cycle of the plurality of plunger lifts.

The device control unit 500 provides various sensors for performing a control logic of an actual plunger lift oil and/or gas well and interfaces required to control the production valves.

An example of an operation of the multi-plunger lift control device 10 according to an embodiment of the present disclosure is described in detail below with reference to FIG. 5.

Figure 5:
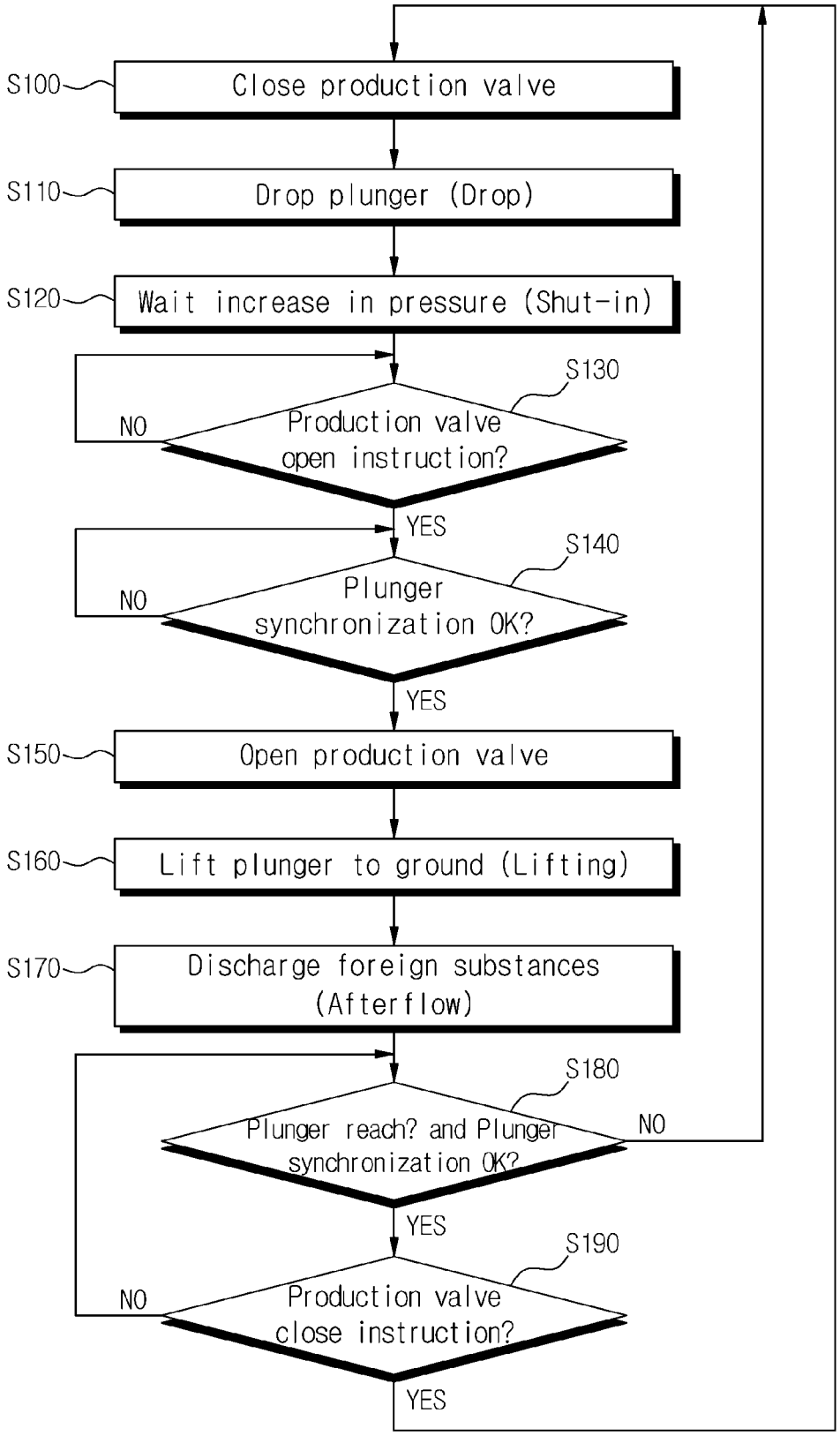
FIG. 5 illustrates an example of an operation of a multi-plunger lift control device according to an embodiment of the present disclosure.

FIG. 5 illustrates an example of an operation of the multi-plunger lift control device 10 according to an embodiment of the present disclosure.

Referring to FIG. 5, in step S100, a process of closing the production valve is performed along with a start of a production cycle.

In step S110, after closing the production valve, a drop stage is performed to drop a plunger to a bottom of a reservoir, in which an oil and/or a gas is stored, through tubing.

In step S120, after dropping the plunger, a shut-in stage is performed to wait until an internal pressure of the tubing reaches a set producible pressure.

In step S130, after the shut-in stage is performed, a process is performed to check a production valve open instruction for pulling the oil and/or gas to the ground. For example, this process may be performed by a control logic of a specific plunger lift included in the plunger lift logic control unit 300.

In step S140, a process is performed in which the control logic of the specific plunger lift included in the plunger lift logic control unit 300 determines whether a production operation synchronization condition of the plurality of plunger lifts is satisfied with reference to a control logic of other plunger lift before opening a specific production valve controlled by the specific plunger lift so as to perform the lifting stage and the afterflow stage.

In step S150, when the production operation synchronization condition for preventing a collision between production stages of the plurality of plunger lifts is satisfied, a process is performed in which the control logic of the specific plunger lift opens the specific production valve controlled by the specific plunger lift so as to perform the lifting stage and the afterflow stage.

In step S160, after a production valve installed on a production line on the ground connecting the tubing and an external storage is opened, the lifting stage of raising the plunger to the ground using an internal pressure difference between the tubing and a production line is performed. Through the lifting stage, the oil and/or gas is produced and stored.

In step S170, an afterflow stage of discharging foreign substances in the tubing is performed.

In step S180, the plunger reaches a specific position on the ground, and a process is performed to determine whether the production operation synchronization condition of the plurality of plunger lifts is satisfied.

If the production operation synchronization condition for preventing a collision between the production stages of the plurality of plunger lifts is not satisfied as a determination result in step S180, the production valve is closed immediately regardless of a production valve close instruction, thereby preventing a collision with production stages of other plunger lifts.

In step S190, in a state where the plunger reaches the specific position on the ground, and the production operation synchronization condition for preventing a collision between production stages of the plurality of plunger lifts is satisfied, a process of checking a production valve close instruction is performed.

As described above, the multi-plunger lift control device according to the present disclosure can increase device durability and production efficiency by synchronizing and controlling operating states of a plurality of plunger lifts in an environment that shares a production line for transporting the oil and/or gas produced in a plurality of oil and/or gas wells, in which the plurality of plunger lifts are installed, to a remote storage.

The multi-plunger lift control device according to the present disclosure can also prevent an abnormal pressure increase in a production line shared by a plurality of plunger lifts and prevent a backflow from the shared production line to an individual oil and/or gas well by synchronizing and controlling operating states of the plurality of plunger lifts.

The multi-plunger lift control device according to the present disclosure can also perform a continuous oil and/or gas production process even in a minimal production facility environment by configuring efficient control logic synchronization for a plurality of plunger lifts in an oil and/or gas well production control environment of the plurality of plunger lifts sharing a production line, and can support to perform optimal production control by comparing and providing various operating states and production data statistical information for optimal operation of the oil and/or gas well.

What is claimed is:

1. A method for synchronizing and controlling operating states of a plurality of plunger lifts sharing a plurality of production lines, using a multi-plunger lift control device, the method comprising:

setting, using a plunger lift synchronization setting unit, operation priority of the plurality of plunger lifts so that production stages of the plurality of plunger lifts do not collide;

monitoring, using a stage monitoring unit for each plunger lift, current production stages of the plurality of plunger lifts; and synchronizing and controlling, using a plunger lift logic control unit, production operations of the plurality of plunger lifts based on the operation priority set by the plunger lift synchronization setting unit and stage monitoring information received from the stage monitoring unit for each plunger lift, wherein the production stage comprises:

a drop stage of dropping a plunger to a bottom of a reservoir, in which an oil and/or a gas is stored, through a tubing;

a shut-in stage of waiting until an internal pressure of the tubing reaches a set producible pressure;

a lifting stage of lifting the plunger to a ground using an internal pressure difference between the tubing and a production line by opening a production valve installed on a production line on the ground connecting the tubing and an external storage; and an afterflow stage of discharging foreign substances in the tubing, wherein the plunger lift logic control unit is configured to synchronize and control the production operations of the plurality of plunger lifts so that two or more plunger lifts of the plurality of plunger lifts do not perform the lifting stage and the afterflow stage at the same time, wherein the plunger lift logic control unit is configured to generate a control logic for each of the plurality of plunger lifts based on the operation priority set by the plunger lift synchronization setting unit, wherein the control logic for each of the plurality of plunger lifts includes at least a priority of the lifting stage and the afterflow stage among the production stage of each of the plurality of plunger lifts, wherein the plunger lift logic control unit is configured to perform the control logic for each of the plurality of plunger lifts, and wherein a control logic of a specific plunger lift included in the plunger lift logic control unit synchronizes and controls the production operations of the plurality of plunger lifts with reference to a control logic of another plunger lift before opening a specific production valve controlled by the specific plunger lift so as to perform the lifting stage and the afterflow stage, to thereby prevent a collision between the production stages of the plurality of plunger lifts.

2. The method according to claim 1, wherein the plunger lift logic control unit synchronizes and controls the production operations of the plurality of plunger lifts to prevent an excessive pressure increase of a shared production line shared by the plurality of plunger lifts and to prevent a backflow due to a pressure difference between the shared production line and a non-shared production line that is not shared by the plurality of plunger lifts.

3. The method according to claim 1, further comprising:

a plunger lift statistical information generation unit configured to compare and analyze control operation environment data and production data of the plurality of plunger lifts that change over time, and generate statistical information that supports a user to set the operation priority of the plurality of plunger lifts through the plunger lift synchronization setting unit.

4. The method according to claim 3, wherein the statistical information includes production quantity information per production cycle of the plurality of plunger lifts and daily production quantity information of the plurality of plunger lifts.

5. The method according to claim 4, wherein the statistical information further includes information on production cycle during a unit period of the plurality of plunger lifts, and information on occupation time for each production stage, current production stage progress time, and progress.

6. The method according to claim 5, wherein the statistical information is provided on one screen for mutual comparison for each of the plurality of plunger lifts and supports the user to set the operation priority of the plurality of plunger lifts through the plunger lift synchronization setting unit.

7. The method according to claim 4, wherein the statistical information further includes information on a plunger lifting speed per production cycle of the plurality of plunger lifts.

* * * * *